United States Patent [19]

Grant et al.

[11] Patent Number: 4,699,298

[45] Date of Patent: Oct. 13, 1987

[54] BUNG CONNECTION

[75] Inventors: Robert W. Grant, Pleasanton, Calif.; Joshua P. Waldman, Edina, Minn.

[73] Assignee: FSI Corporation, Chaska, Minn.

[21] Appl. No.: 815,025

[22] Filed: Dec. 30, 1985

Related U.S. Application Data

[63] Continuation-in-part of Ser. No. 713,869, Mar. 20, 1985, abandoned.

[51] Int. Cl.[4] ..... B65D 83/00

[52] U.S. Cl. ..... 222/400.7; 222/542; 222/545; 285/914

[58] Field of Search ..... 222/400.7, 400.8, 464, 222/512, 542, 545, 549, 552, 563, 23, 41, 153; 137/212; 285/914

[56] References Cited

U.S. PATENT DOCUMENTS

| | | | |
|---|---|---|---|
| 850,070 | 4/1907 | Spikes | 222/400.7 |
| 928,813 | 7/1909 | Spikes | 137/588 |
| 1,304,390 | 5/1919 | Semenow et al. | 222/482 |
| 2,186,925 | 1/1940 | Hooper et al. | 137/321 |
| 2,547,084 | 4/1951 | Marcuse | 239/340 |
| 2,790,571 | 4/1957 | Flaith et al. | 217/99 |
| 3,149,763 | 9/1964 | Exton | 222/542 X |
| 3,228,413 | 1/1966 | Stevens, Jr. | 137/322 |
| 3,265,233 | 8/1966 | Tuuri | 222/545 X |
| 3,273,586 | 9/1966 | Killmeyer | 137/268 |
| 3,287,031 | 11/1966 | Simmons et al. | 285/914 X |
| 3,861,569 | 1/1975 | Johnston | 222/400.7 |
| 4,134,522 | 1/1979 | Patzke et al. | 222/153 |
| 4,150,673 | 4/1979 | Watt | 285/914 X |
| 4,211,439 | 7/1980 | Moldestad | 285/914 X |
| 4,362,255 | 12/1982 | Bond | 222/542 X |
| 4,411,287 | 10/1983 | Hyde | 137/315 |
| 4,529,105 | 7/1985 | Lewins | 222/153 |

*Primary Examiner*—Robert J. Spar
*Assistant Examiner*—Jay I. Alexander
*Attorney, Agent, or Firm*—Palmatier & Sjoquist

[57] ABSTRACT

A bung connection for a rigid container has a bung body which threads into the bung opening, and has a base wall with two or more access openings which are connected to tubes extending to the flowable material in the container. A tube mounting is removably inserted into the bung body and has flow ports which connect with the access ports in the base wall. Flow tubes connect to the tube mounting. The tube mounting and bung body have a coded pattern of interfitting lugs and recesses which prevent full assembly of the tube mounting and bung body if the coding is wrong. A clamp ring secures the tube mounting in the bung body. A shipping plug and liner replace the tube mounting in the bung body for shipping the container to be refilled and then returned for use again.

2 Claims, 13 Drawing Figures

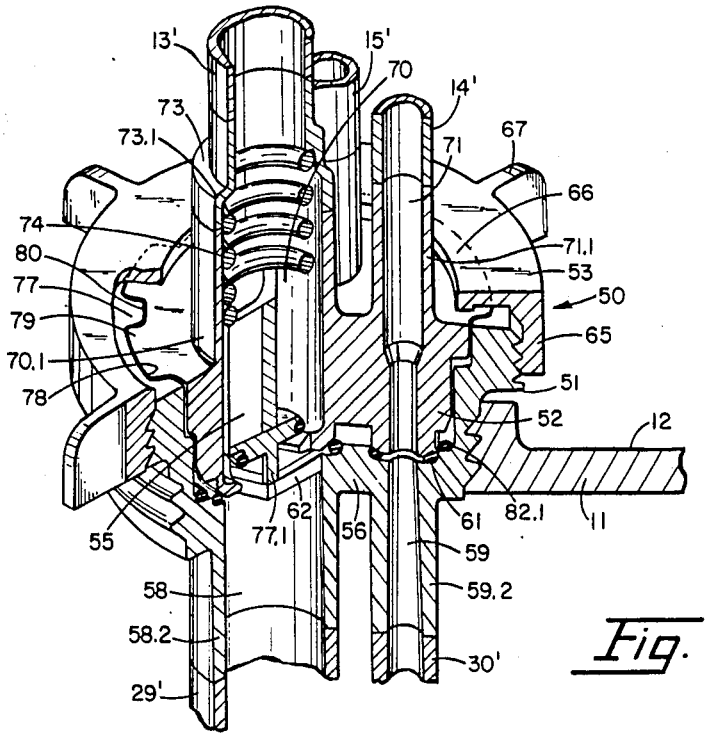
Fig. 7
Fig. 8
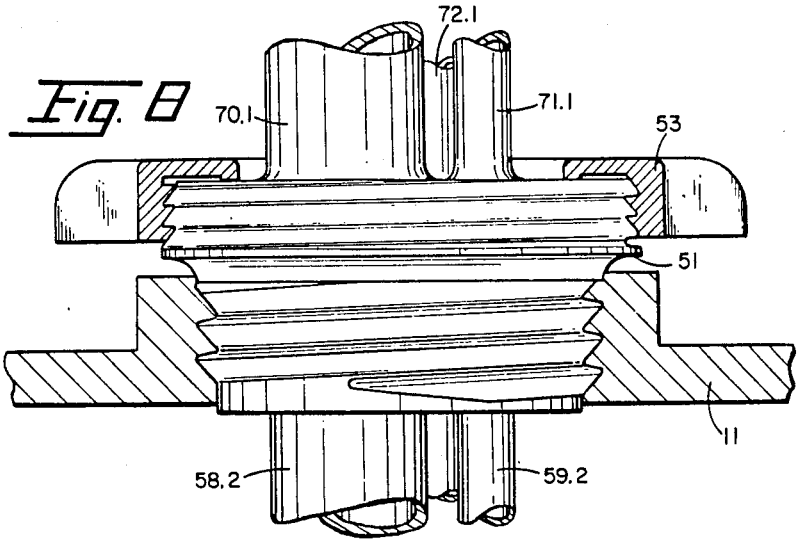

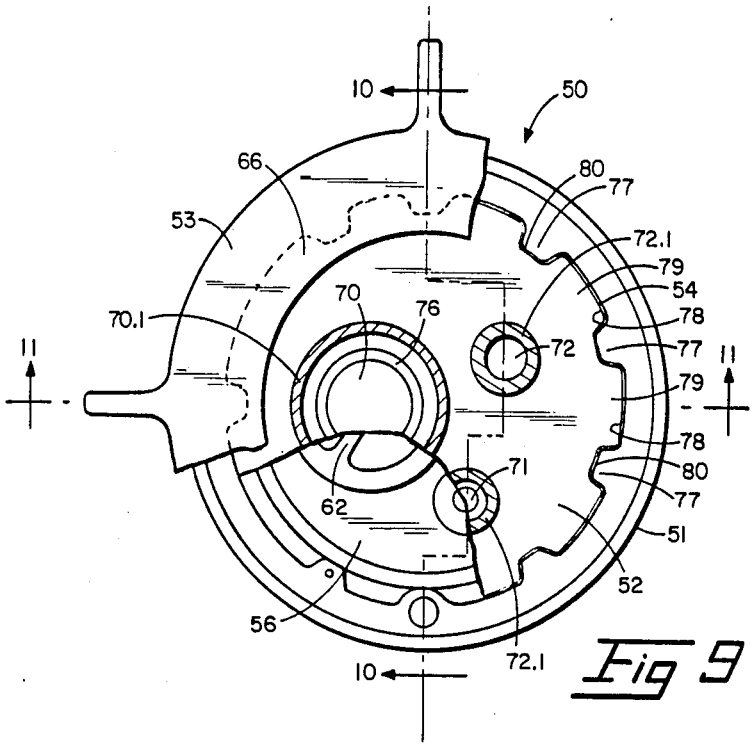
Fig 9
Fig 10
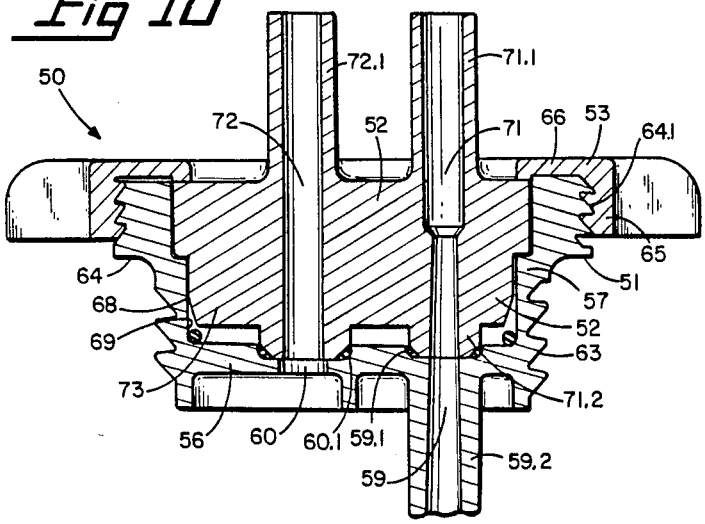

BUNG CONNECTION

This application is a continuation-in-part of application Ser. No. 713,869, filed Mar. 20, 1985, now abandoned.

BACKGROUND OF THE INVENTION

This invention relates to a connection for tubes or pipes into the bung opening of a barrel for drawing liquid therefrom.

Various types of bung connections have been used with barrels and other containers in the past and have worked satisfactorily for their intended purposes. In dispensing beer and other beverages, the connections need to be made quickly while maintaining a degree of cleanliness. Numerous prior patents have illustrated various bung connections. For instance U.S. Pat. No. 928,813, issued July 20, 1909 to Spikes shows a beer tapper utilizing a coupling, attached by fittings to the tubes, and requiring that the coupling and tubes be rotated for disconnecting from the bung casing attached to the barrel. The turning of the removable coupling operates a valve on the bung case.

In the Killmeyer U.S. Pat. No. 3,273,586, issued Sept. 20, 1966, an annular casing is inserted into the lid of the drum; and a plastic insert disk is supported in the casing and clamped therein. The disk or insert mounts a tubing which extends into the barrel and also mounts tube fitting for tubes extending to the exterior. Other generally related patents include U.S. Pat. Nos. 1,304,390; 2,186,925; 2,790,571; and 3,005,475.

SUMMARY OF THE INVENTION

An object of the invention is to provide a bung connection suitable for connecting tubes to a reusable rigid container such as a barrel or drum, so as to maintain a high degree of purity of the liquids or other flowable materials, such as powder, being drawn from the drum and which is easily transferred to another drum of the same liquid, but not to a drum of a different liquid.

A feature of the invention is the provision of a bung connection incorporating a bung body attached into the lid or end panel of the container and having one or more tubes extending into the bottom of the container for withdrawing liquid from the barrel. It is contemplated that the bung body will remain in the bung of a container, and succession of containers will also have similar bung bodies therein. A removable tube mounting, or spool is attached to tubes or pipes at the exterior of the container. These exterior tubes or pipes are used to draw liquid from the container and to deliver air to the container. The tube mounting is insertable into or removable from the bung body, and when placed in the bung body is clamped therein by a removable clamp. The clamp may take the form of a ring or an annular bushing inserted between the tube mounting and the bung body, and threaded to the bung body. Alternately, the clamp may take the form of a clamp ring or cap overlying the tube mounting and threaded onto the bung body.

The bung body has a transverse base wall with openings therein for liquid communication and for mounting the tubes that extend down into the bottom of the barrel. Flow ports in the tube mounting align with the openings in the base wall of the bung body for establishing a sealed flow passage from the tube mounting to and through the base wall of the bung body. Coded indexing lugs and recesses are provided in the bung body and tube mounting to allow assembly of the tube mounting and bung body only when the correct coding of the lugs and recesses exists. The orientation and spacing of the lugs and recesses serve as a coding to assure that there is a proper coordination between the tube mounting and the drum and bung body into which the tube mounting and the drum and bung body into which the tube mounting must fit. In one form, the coding may be provided by a pattern of interfitting lugs and recesses or grooves at the peripheral interface between the tube mounting and the bung body, and in another form, the lugs and recesses are at the base end of the tube mounting and in the base wall of the bung body.

The bung body may be closed, after removal of the tube mounting, by a closure comprising a liner laid against and sealed to the base wall of the bung body, and a shipping plug which is threaded on the bung body and which applies sealing pressure onto the liner without requiring the liner to rotate. Allowing the liner to remain stationary without rotating as pressure is applied, prevents the creation of contaminating particulate.

The clamp ring may be readily released, facilitating lifting the tube mounting out of the bung body so that the tube mounting may be moved over to an adjacent container and inserted into its bung body as to obtain an additional supply liquid. Of course, the coding or indexing lugs must fit the coded recesses in the bung body of the adjacent barrel. The tube mounting will then be clamped in the bung body of the new supply container by the clamp; and the spent container with the bung body will be returned to a source of liquid for replenishing the supply therein. A check valve in the tube mounting prevents liquid in the delivery tubes from draining out of the mounting when the mounting is removed from the bung body for transfer to the new container.

The present bung connection facilitates rapid transfer of the delivery tubes from one container to another, while requiring a high degree of accuracy so that only the correct container may be connected, and an extremely pure or sterile relationship can be maintained because of the parts need not touch any extraneous equipment or facilities during the transfer. The tube in the container will stay with the container so that it need not be withdrawn through the small bung hole in the lid of the barrel.

BRIEF DESCRIPTION OF THE DRAWINGS

FIG. 7 is a perspective view, partly broken away and shown in detail, of a second preferred form of the invention.

FIG. 8 is an enlarged elevation view of the form showing in FIG. 7, with certain portions broken away and shown in section.

FIG. 9 is a section view taken approximately at 9—9 of FIG. 8 and having portions broken away for clarity of detail.

FIG. 10 is a detail section view taken along the irregular line indicated at 10—10 in FIG. 9.

DETAILED SPECIFICATION

Figure 1:
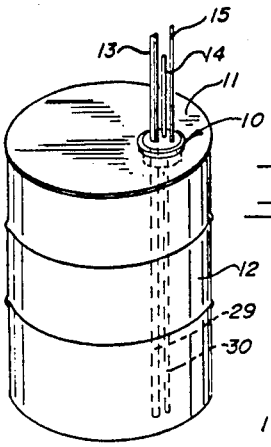
FIG. 1 is a perspective view showing a drum in which the bung connection is installed.
Figure 2:
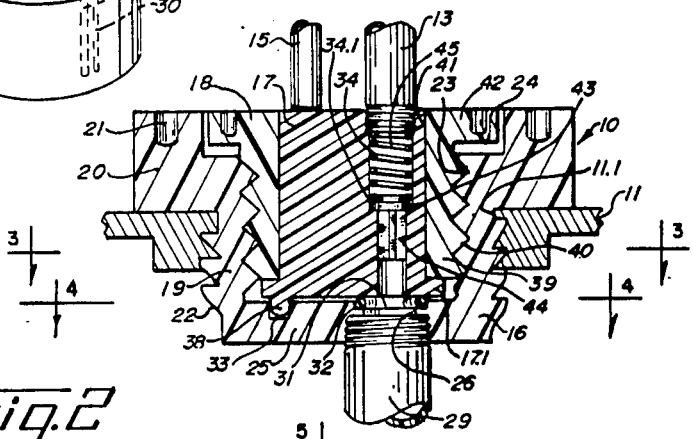
FIG. 2 is an enlarged detail section view through the bung connection and taken on a line as indicated at 2—2 in FIG. 3.
Figure 3:
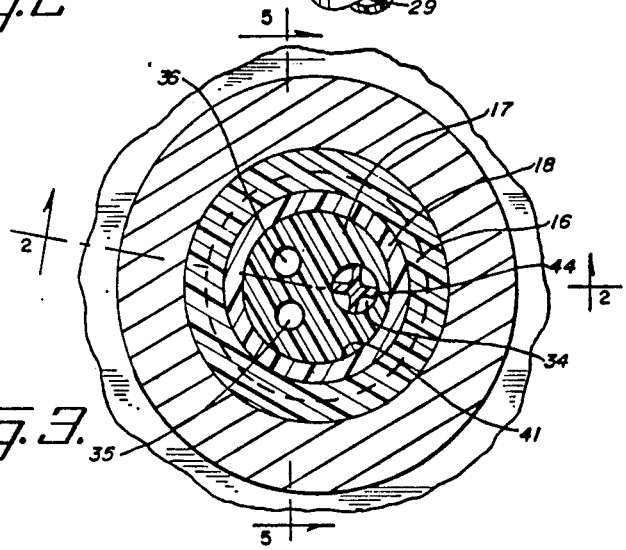
FIG. 3 is a detail section view through the bung connection as indicated at 3—3 of FIG. 2.
Figure 4:
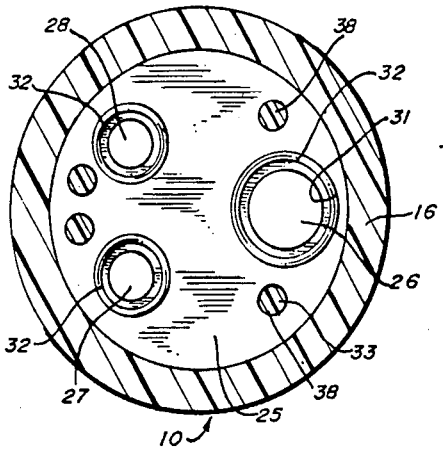
FIG. 4 is a detail section view taken approximately at 4—4 in FIG. 2.
Figure 5:
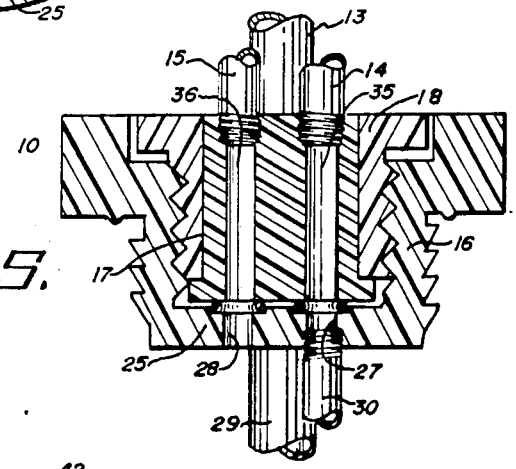
FIG. 5 is a detail section view taken approximately at 5—5 of FIG. 3.

One form of the invention is illustrated in the drawings and is described in FIGS. 1–6 herein. The bung connection is indicated in general by numeral 10 and is adapted to be mounted in the lid or end plate 11 of a container, such as a storage drum or barrel 12 of suitable capacity, such as 55 gallons, but of course, the bung connection may be mounted in a top panel of any type of storage receptacle where the connections need to be changed from time to time.

As illustrated in FIG. 1, the bung connection serves a purpose of connecting a number of tubes or pipes 13, 14 and 15 to the drum 12. Typically, the tube 13 will be for the purpose of withdrawing liquid from the drum 12; tube 15 is for the purpose of supplying air into the drum to replace the liquid as the liquid is drawn from the drum; and tube 14 is for the purpose of connecting two apparatus for sensing the level of liquid in the drum 12.

The bung connection 10 has three principal parts, each formed of a plastic material which is preferably highly resistant to the deteriorating effects of highly active or strong chemicals, such as acids, and typically the bung connection 10 is made of a fluoropolymer plastic, such as Teflon PFA, or perfluoroalkoxy, sold under that brand by E.I. DuPont DeNemours of Wilmington, Del. Alternately, the parts of the bung connection may be made from a wide range of plastics or metals, depending upon the nature of the liquid being handled. Polyethylene may be used in some circumstances.

More specifically, the bung connection has a bung body or casing 16; a tube mounting 17; and a clamp ring or clamp bushing 18. A coded aligning means 33, 38 assures that the tube mounting may be assembled with only drums which are properly coded and have the correct chemical to be supplied to the tubes.

The bung body or casing 16 is generally receptacle shaped and has an annular and generally cylindrical wall 19 and an outwardly turned peripheral flange 20 with recesses 21 opening through the upper face thereof to receive a tool for turning or rotating the bung body 16 relative to the lid 11 of the drum. The annular wall 19 of the bung body has threads 22 on its outer periphery for threading into the threaded bung hole 11.1 of the drum lid 11. The annular wall 19 of the bung body also has threads 23 formed on its inner periphery.

The bung body also has an upwardly facing circular recess in the flange 20 extending peripherally around the hollow interior defined by threads 23 and defining a shoulder surface 24.

The bung body 16 also has a transverse base wall 25 traversing the inner end of the annular wall 19, as to close the interior of the bung body. The base wall 25 has a number of access ports 26, 27 and 28 formed therethrough. The access ports 26 and 27 are threaded and mount the threaded ends of tubes 29 and 30, respectively, which extend from the base wall 25 of the bung body to the bottom of the drum 12. The tubes 29 and 30 are also preferably formed of plastic which is highly resistant to the deteriorating effects of chemicals, such as acids, and such tubes 29 and 30 may be formed of the fluoropolymer plastic such as Teflon.

The base wall 25 also has peripheral recesses 31 at each of the access ports 26, 27 and 28 for confining O-rings 32.

The base wall 25 also has a plurality of indexing recesses 33 spaced from all of the access ports.

The removable tube mounting 17 has the approximate length of the depth of the interior opening of the bung body 16. Tube mounting 17 has a plurality of flow ports 34, 35 and 36 extending endways therethrough from the outer end to the base end which confronts the base wall 25 of the bung body. The tube mounting 17 has all of the tubes 13, 14 and 15 affixed thereto, and as illustrated, the tubes 13, 14 and 15 are threaded and are turned into the threaded ends of the respective flow ports 34, 35 and 36.

The tubes 13, 14 and 15 are also preferably formed of a plastic which is highly resistant to the deteriorating effects of chemicals, such as acids, and preferably the tubes are formed of a fluoropolymer, such as Teflon.

The ports 34, 35 and 36 are arranged in the tube mounting 17, in the same arrangement as the access ports 26, 27 and 28 in the base wall of the bung body as to be aligned with the access ports when the tube mounting 17 is assembled into the bung body. In order to assure that the flow ports 34, 35 and 36 will align precisely with the access ports 26, 27 and 28, the tube mounting 17 is provided with a multiplicity of indexing lugs or nibs 38 to align with the several indexing recesses 33 and be inserted therein when the tube mounting 17 is assembled into the bung body 16. The lugs 38 and recesses 33 provide to combine coded aligning means between the tube mounting and the bung body. The lugs and recesses are spaced relative to each other and are oriented in such a coded pattern so that they will only fit together in a certain arrangement. The lugs and recesses must fit together, otherwise the tube mounting will not seat properly within the bung body and flow communication will not be established between the access ports in the base wall 25 and the flow port in the tube mounting. The coded aligning means serves to prevent the likelehood of supplying the wrong chemicals to the tubes, as the assembly of the tube mounting with a bung body with an erroneous coding will be virtually impossible.

The clamp ring or clamp bushing 18 is annular in shape and has an elongate annular wall 39 with threads 40 formed in its outer periphery for threaded assembly with the threads 23 on the inner periphery of the annular wall 19 of the bung body. The annular wall 39 of the clamp ring 18 has a smooth and cylindrical inner periphery 41, as to receive, but be slidable along the cylindrical outer periphery of the tube mounting 17.

The clamp ring 18 also has an outturned top flange 42 with a multiplicity of recesses therein for attaching a tool in order to revolve the clamp 18 within the bung body 16.

Figure 6:
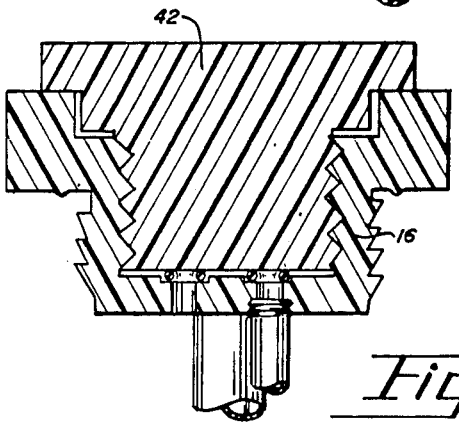
FIG. 6 is a detail section view similar to FIG. 5, but showing a closure plug in the bung body.

As illustrated in FIG. 6, a closure plug 42 may be provided for replacing the tube mounting 17 and clamp 18 when the drum is to be closed for storage or shipment.

The tube mounting 17 preferably incorporates a check valve 43 in the flow port 34 and bearing against a valve seat 34.1. The valve 43 has an elongate cross shaped guide portion 44 slidably along a portion of the flow port 34 when pressure in the passage lifts the valve element off the seat. A coil spring 45 is seated against the end of tube 13 in the flow port 34 and bear against the valve element 43 to normally urge the valve element into closed condition on the seat. When the tube mounting 17 is removed from the bung body, the check valve 43 will normally close and prevent dripping of liquid from the tube 13.

In the use of the bung connection 10, the bung body 16 is mounted in the lid or end panel of the drum 12 and will remain in the drum while the liquid is being withdrawn from the drum; while the drum is being transported back to the source of chemical and being refilled and while the drum is again transported to the site where the liquid is to be used or withdrawn from the drum. Accordingly, the tubes 29 and 30 within the drum 12 will also remain in fixed relation with the bung body 16 while the bung body remains attached to the lid or top panel 11 of the drum.

As indicated in the specification and drawings, the flow ports 35, 36 and 37 in the tube mounting 17 are aligned with an in flow communication with the access ports 26, 27 and 28, respectively, in the base wall 25 of the bung body, so that the tubes 13 and 14 are in flow communication with the tubes 29 and 30, respectively, and the tube 15 may supply air into the interior of the drum through the access port 28.

Suitable pumping equipment will be attached to the tube 13 to withdraw the liquid chemical from the drum 12; and suitable sensing equipment will be attached to the tube 14 in order to continuously sense the depth of liquid remaining in the drum through the communication provided by tube 30 which is continuously carried within the drum and attached to the bung body.

When the supply of liquid chemical in the drum is depleted, another drum of liquid chemical is placed adjacent to the drum 12 so that the tubes 13, 14 and 15 may be conveniently connected to the next drum providing a supply of the liquid chemical. The clamp ring or clamp bushing 18 is turned, with the use of a suitable tool, so as to be separated from the bung body. In this respect, the clamp 18 will revolve around the stationary tube mounting 17, and when the threads are disconnected from the inner threads of the bung body, the clamp ring 18 is lifted away from the tube mounting 17 and from the bung body 16 and is moved along the tubes 13, 14 and 15 a short distance. The tube mounting is then lifted out of the bung body 16, thereby disconnecting the tubes 13, 14 and 15 from the drum 12. The tube mounting and the ends of the tubes are then simply moved over to the other drum containing a supply of the liquid chemical, and the tube mounting is reassembled with the bung body 16 already in place in the second drum.

In assembling the tubes with the second drum, the tube mounting 17 is inserted into the bung body so that the indexing lugs or nibs 38 insert into the indexing recesses 33 and flow ports 34, 35 and 36 will be aligned with the respective access ports 26, 27 and 28 in the base wall of the bung body. the base end of the tube mounting 17 engages the O-rings 32 so as to seal about the periphery of each of the flow ports and access ports, thereby providing a sealed flow communication between the tubes outside of the drum and the tubes within the drum. The coding provided by the arrangement of recesses 33 in the base wall of the bung body will be changed, according to the nature of the chemical actually confined within the drum 11. Unless the coding as to the arrangement of the recesses 33 in the base wall is correct, the tube mounting will not seat down into the bung body and the failure to seat properly will be readily discerned and a costly mistake will be avoided.

When the tube mounting 17 is seated in the bung body 16, the clamp 18 is moved along the tubes 13, 14 and 15 and is inserted in to the bung body while embracing the tube mounting 17 and the clamp 18 may then be revolved so as to turn its threads 40 into the threads 23 at the inner periphery of the bung body.

The inner end of the clamp 18 bears against the shoulder surface of the flange 17.1 on the base end of the tube mounting so that the clamp 18 exerts physical force against the tube mounting and clamps the tube mounting 17 tightly against the O-rings which seal the tube mounting to the base wall of the bung body and thereby provide sealed flow connection.

It will be seen that bung connection 10 may be readily operated for connecting the necessary tubes 13, 14 and 15 to the source drum 12 of the liquid chemical for drawing liquid from the drum and supplying air into the drum and providing other desirable functions such as continuously sensing the depth of liquid in the drum.

When the empty drum is shipped back to the source of liquid chemical, the plug 42 may be simply insertedinto the bung body and turned therein as to keep contaminants out of the drum.

In the preferred form of bung connection illustrated in FIGS. 7–12, the bung connection is indicated in general by numeral 50, and like the bung connection 10, it is adapted to be mounted in the lid or top panel 11 of the container or drum 12, for providing connections from the tubes 29', 30' within the drum and to the tubes 13', 14' and 15' at the exterior of the drum.

In general, the bung connection 50 has a bung body 51, a tube mounting 52 and a clamp ring 53. The bung body and the tube mounting have a coded and interfitting aligning means 54 therebetween. In addtiion, the tube mounting 52 incorporates a valve mechanism 55 to prevent drainage of liquid from the tube 13 when the tube mounting 52 is removed from the bung body for insertion into a similar bung body of another drum.

As in the case of the bung connection 10 in FIGS. 1–6, the bung connection 50 is also formed entirely of molded plastic which is highly resistant to the deteriorating effects of strong chemicals, such as acids, and in one embodiment, the bung connection is molded of Teflon PFA as is the bung connection 10 of FIGS. 1–6. It will be recognized that the bung connection may, alternately, be formed of any of a broad range of plastics, or of metal, depending upon the nature of the liquids being supplied in the containers.

The bung body 51 has a base wall 56, which is molded integrally with an upstanding annular peripheral wall 57. The base wall 56 has a plurality of access openings 58, 59 and 60 therethrough for passage of fluids, and the upper surface of the base wall 56 has recesses 58.1, 59.1 and 60.1 which are concentric of the corresponding access ports for sealing gaskets or O-rings 61.

The base wall 56 also forms an open grid work 62, which traverses the access port 58 to accommodate operation of the valve 55 in the tube mounting.

The bung body 51 also has a pair of depending bosses or tubing stubs 58.2, 59.2 respectively aligned with the access ports 58, 59 for connection as by welding to tubes 29', 30' extending down into the drum 12.

The peripheral wall 57 of the bung body has threads 63 along its lower portion to thread into the bung hole of the lid 11; and the outwardly protruding flange or shoulder 64 in the peripheral wall 57 will abut against the top edge of the bung of the barrel lid 11 when the bung body is properly seated in the lid 11.

The peripheral wall 57 of the bung body also has threads 64.1 on its outer periphery at the upper portion for securely mounting the threaded outer wall 65 of the clamping ring 53 so that the annular panel 66 of the clamp ring will lie flush against the upper surface of the tube mounting 52. The clamp ring 53 is provided with a plurality of outwardly protruding flanges 67, which provide convenient manual gripping for turning the ring 53 without tools. The threads 65.1 on the clamp ring 53 have a length which is substantially the same as or slightly less than the length or depth of the lugs 79 on tube mounting 52. As a result, if the lugs 79 will not fit into the recesses 78, due to erroneous coding, the tube mounting will protrude from the wall of the bung body so far that the threads on the clamp ring will not engage or catch the threads on the wall 57 of the bung body.

The tube mounting 52 has a substantially cylindrical outer periphery 68, which fits in close fitting relation with the inner periphery 69 of the peripheral wall 57 of the bung body. The tube mounting 52 has a plurality of flow ports 70, 71 and 72, which extend endways through the tube mounting and open through the base end 73 and also through the outer end of the tube mounting. The flow openings, 70, 71 and 72 are arranged identically with the access ports 58, 59 and 60 in the base wall 56 of the bung body, and as illustrated, when the tube mounting is assembled with the bung body, the flow ports 70, 71 and 72 are aligned and in flow communication with the corresponding access ports in the base wall of the bung body.

The tube mounting 52 has bosses or tubing stubs 70.1, 71.1 and 72.1 formed integrally thereof and arranged in alignment with the respective flow ports 70, 71 and 72, for the purpose of connecting to the flow tubes 13', 14' and 15', respectively, as by welding.

Figure 11:
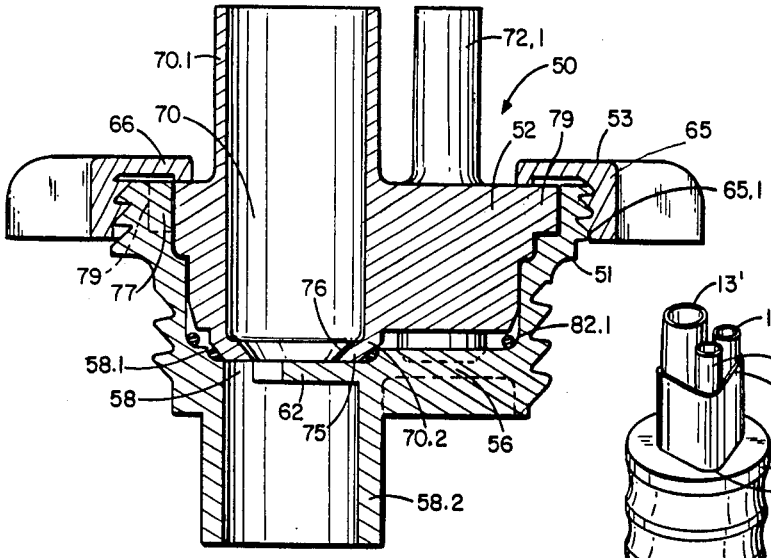
FIG. 11 is a detail section view taken approximately at 11—11 of FIG. 9.

As seen in FIG. 7, the tubing stub 70.1 normally has a plastic tube fitting 73 connected thereto, as by welding, to provide the connection between the tubing stubs 70.1 and the corresponding tubing 13'. The fitting 73 provides an anchor shoulder 73.1 for a spring 74 which bears against the valve 55 slidably mounted within the flow port 70. As best seen in FIG. 11, the tube mounting 52 has an inwardly protruding annular flange 75 at the lower end of the flow port 70 and defining a tapered annular valve seat 76, against which the valve 55 seats and seals when the valve 55 is allowed to move down onto the seat 76. The spider or grid work 62 in the access opening 58 of the base wall 56 normally bears against the protuberance or pin 77.1 extending downwardly from the bottom face of the valve element 55 for the purpose of keeping the valve element 55 upwardly off the valve seat 76 and in spaced relation with the valve seat so that flow can continue to the aligned access port 58 and flow port 70.

At the adjoining outer and inner peripheries of the tube mounting 52 and peripheral wall 57, the coded aligning and indexing means 54 is provided. The peripheral wall 57 of the bung body 51 is provided with a multiplicity of inwardly protruding lugs 77 variously spaced from each other around the inner periphery of the annular wall 57. The inwardly protruding lugs 77 define a corresponding multiplicity of recesses 78 in the inner periphery of the wall 57 which are of varying width according to the varying spacing between adjacent lugs 77.

Similarly, the tube mounting 54 is provided with a multiplicity of outwardly protruding lugs 79 which have varying widths around the periphery of the tube mounting 52. Correspondingly, the tube mounting 52 defines a multiplicity of recesses 80 between the adjacent lugs 79, which recesses 80 are variously spaced from each other. according to the lugs 79. The several demountably assembled lugs and recesses 77, 78, 79 and 80 are coded to interfit with each other in a predetermined relation, and when the lugs and recesses do fit together, the tube mounting 52 seats properly within the bung body 51 so that the base end 73 thereof properly confronts the base wall 56 of the bung body.

The tube mounting 52 has a plurality of downwardly protruding bosses 70.2, 71.2 and 72.2, each of which embraces a respective flow port 70, 71 and 72 and each of which protrudes downwardly from the base end 73 of the tube mounting 52 and into the corrresonding recesses 58.1, 59.1 and 60.1, so as to seat firmly against the O-rings in those recesses, thereby providing a sealed flow communication between all of the flow ports in the tube mounting and the access port in the base wall 56.

It will be recognized that in the event an erroneous coding or positioning among the several lugs and recesses 77, 78, 79 and 80 occurs, the lugs will not fit into the recesses properly, and the lugs 79 on the tube mounting 52 will not fit down into the recesses 78, but will abut against the top surfaces of certain of the lugs 77 and thereby provide stops preventing the complete assembly of the tube mounting 52 with the bung body 51. As a result of this incomplete assembly of the tube mounting with the bung body, the clamp 53 cannot be fastened to the outer periphery of the sidewall 57 and the threads on the sidewall 65 of the cap 53 will not catch into the corresponding threads on the sidewall 57. Accordingly, the person attempting to assemble a tube mounting 52 and bung body 57 with erroneous coding in the lugs and recesses 77-80, will quickly observe that because he cannot make the assembly, the chemical in the drum is, in all probability, the wrong chemical to be supplied into the tubes 13', 14' and 15'.

When the drum of the proper chemical is subsequently located, it will have the correct coding to fit with the tube mounting.

When the supply of chemical in one drum is depleted, the cap 53 will be turned free of the bung body 51 and will be moved a short distance upwardly along the tubes 13', 14' and 15'. The tube mounting 52 may then simply be lifted out of the bung body, and be moved over to a drum which is full of the correct chemical. The tube mounting will be simply inserted into the bung body of the second drum and the clamping cap 53 will be moved downwardly and threaded onto the outer periphery of the peripheral wall of the bung body until the cap clamps the tube mounting in its proper location in the bung body. In the unlikely event that the operator has selected a barrel of improper or wrongly identified chemical, the tube mounting 52 will not sit down into the bung body and the assembly cannot be effected.

Figure 12:
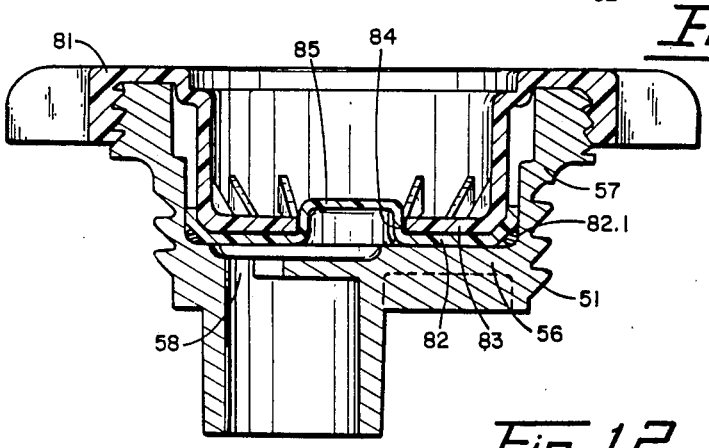
FIG. 12 is a section view similar to FIG. 11, but with the tube mounting replaced by a shipping plug and plug liner.

In FIG. 12 is illustrated a shipping plug 81 which may be threaded onto the peripheral wall 57 of the bung body 51; and a sealing liner 82 will bear firmly against the base wall 56 of the bung body and against an O-ring 82.1 at its periphery and will entirely close the access ports in the base wall so that the drum may be shipped and refilled. The liner lies against the base wall 56 and is restrained from rotation as the shipping plug 81 is rotated to assemble the threads. By allowing the liner to remian stationary, contaminating particulate is not generated. The pressure base 83 of the shipping plug has a concentric opening 84 therein, and receives the central hub 85 of the liner 82. The tubes 29', 30' within the drum need not be removed in the normal use of the drum and will stay in the drum through its useful life or for several refillings of chemical into the drum. It will be seen that we have provided a bung connection which minimizes the likelihood of contamination of the chemical during the normal use of the bung connection and during the transfer of the tube mounting from one drum to another. The indexing coding means assures that the tubes extending upwardly from the tube mounting will be connected to a drum containing the correct chemical because if a drum of incorrect chemical is encountered, the coding within the bung body will be incorrect as relates to the coding on the tube mounting and a proper connection cannot be effected and this will be observed by the operator attempting to make the connection.

Figure 13:
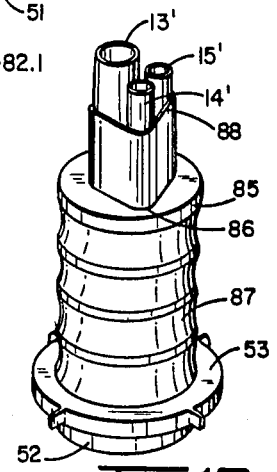
FIG. 13 is a perspective view, illustrating a handle for the tube mounting of the bung connection.

In FIG. 13, the tube mounting 52 is provided with a handle 85 with openings 86 longitudinally therethrough and receiving the flow tubes 13', 14' and 15', which are affixed as by welding to the tube mounting 52 as previously described. The outer periphery of the handle 85 is contoured as indicated at 87 to conveniently be gripped by a person's hand.

The clamp ring 53 is confined by the lower end of the handle 85, but is free to rotate with respect to both the tube mounting 52 and the handle 85, so that the clamp ring may be threaded onto and off the bung body as described. The handle 85 is restrained from sliding along the tubes 13', 14' and 15' by a gripping band 88, which embraces all of the three tubes. Although the band 88 may be formed in a number of ways, a preferred form is to be formed of a heat shrinkable plastic which is shrunk into gripping relation with the tubes after it is in place adjacent the handle.

The handle 85 facilitates handling of the tube mounting and of the several tubes without creating mechanical stress on the connections between the tubes and the tube mounting.

We claim:

1. A bung connection for successively coupling flow connection tubes to the bung hole of a container in a succession of containers of flowable liquid material, comprising a bung body having means for attaching into the bung hole of the container, and also having a base wall traversing the bung hole, the base wall having a pair of access ports therethrough and having a liquid supply tube connected with one of said access ports for extending into the liquid supply of the container.

a removable tube mounting demountably assembled with the bung body and having a base end confronting and demountably seated upon the base wall of the bung body, and the tube mounting also having a pair of flow ports extending therethrough and through the base end and in sealed alignment and flow communicating relation with the access ports of the base wall, the tube mounting being connectible to such flow connection tubes at the flow ports.

a clamp means detachably connected between the bung body and the tube mounting and releasably clamping the tube mounting in stationary relation to the base wall of the bung body to provide sealed flow communication between the flow ports of the tube mounting and the access ports of the base wall, the clamp means when detached permitting lifting of the tube mounting off the base wall.

and the bung body and tube mounting having elongate demountably assembled lugs and recesses in a predetermined pattern to allow complete assembly required for said sealed flow communication between the tube mounting the bung body, the elongate lugs and recesses extending entirely transversely of said base wall and permitting and retaining seating of the tube mounting in predetermined relation to the base wall, and whereby to permit assembly of the tube mounting with other bung bodies of successive containers only if the correct predetermined coded pattern exists in the bung body of the container and of the successive containers.

the lugs on the tube mounting having a predetermined length in the direction of assembly, whereby in the event the lugs and recesses of the tube mounting and bung body do not have the same pattern and do not interfit, the tube mounting is spaced from assembled condition with the bung body by said predetermined length, and the clamp means and bung body having matching threads, the threads on the clamp means being no longer than said predetermined length whereby the threads of the clamping means will not extend to the threads of the bung body when an erroneous lug and recess pattern prevents the tube mounting to be assembled with the bung body.

2. A bung connection between a tube and the bung hole of a container, comprising a plastic bung body having threads at its outer periphery for attaching into the bung hole of the container, the bung body also having a base wall traversing the bung hole and having a plurality of access ports therethrough, a flow tube attached to the base wall in alignment with one of said access ports to extend into the container from the bung body, the bung body also having a circularly annular peripheral wall defining an open-topped interior, the peripheral wall having a threaded outer periphery, a plastic removable tube mounting in the interior of the bung body and having a base end confronting and seated on the base wall of the bung body, and the tube mounting also having an outer end opposite the base end, the tube mounting having a plurality of flow ports extending between the ends and in alignment with respective access ports in the base wall, the tube mounting having means for connection to a plurality of flow tubes each in flow communication with a respective flow port and each extending away from the tube mounting and bung body, annular sealing means between the base wall and the base end of the tube mounting and embracing each of the aligned access and flow ports and permitting separation of the tube mounting from the bung body, the outer periphery of the tube mounting and the inner periphery of the peripheral wall of the bung body embracing each other and being slidable along each other in directions toward and away from the base wall, said outer and inner peripheries having a multiplicity of radially outwardly and inwardly protruding and assembled elongate lugs and recesses and extending parallel to said directions and arranged in a coded pattern, said lugs providing stops preventing complete assembly of the tube mounting and bung body when the lugs and recesses are erroneously coded, and a plastic clamp ring with an annular sidewall threaded onto the outer periphery of the peripheral wall of the bung body, the clamp ring also having an annular end panel traversing the sidewall and formed integrally therewith, the end panel traversing the ends of the assembled elongate lugs and recesses of the tube mounting and peripheral wall and bearing against the tube mounting to releasably clamp the tube mounting in stationary relation to the base wall of the bung body and to maintain the flow communication between the flow ports of the tube mounting and the access ports of the base wall, the elongate lugs on the tube mounting having length in said directions greater than the length of threading along the annular sidewall of the clamp ring to prevent threaded attachment of the clamp ring onto the bung body when the lugs and recesses are out of registry.

* * * * *

UNITED STATES PATENT AND TRADEMARK OFFICE

CERTIFICATE OF CORRECTION

PATENT NO. : 4,699,298

DATED : October 13, 1987

INVENTOR(S) : Robert W. Grant, Joshua P. Waldman

It is certified that error appears in the above-identified patent and that said Letters Patent is hereby corrected as shown below:

Column 1, line 48, after "and" and before "succession", insert -- a --.

Column 2, line 18, delete "on" and replace it with --onto--.

Column 5, line 26, delete "an" and replace it with --and--.

Column 6, line 32, insert a space between "ted" and "into".

Column 8, line 14, change the first occurence of "." to --,--.

Column 10, line 15, delete the second occurence of "the" and replace it with --and--.

Signed and Sealed this

Twenty-sixth Day of April, 1988

*Attest:*

DONALD J. QUIGG

*Attesting Officer*

*Commissioner of Patents and Trademarks*